United States Patent [19]

Block

[11] Patent Number: 4,839,998

[45] Date of Patent: Jun. 20, 1989

[54] ABRASIVE APPARATUS

[76] Inventor: Aleck Block, 800 Warner Ave., Los Angeles, Calif. 90024

[21] Appl. No.: 57,627

[22] Filed: Jun. 3, 1987

Related U.S. Application Data

[63] Continuation of Ser. No. 819,546, Jan. 16, 1986, abandoned.

[51] Int. Cl.[4] ..... B24D 17/00

[52] U.S. Cl. ..... 51/376; 51/377

[58] Field of Search ..... 51/358, 376, 377, 364, 51/382, 383; 24/580, 581, 588

[56] References Cited

U.S. PATENT DOCUMENTS

| | | | |
|---|---|---|---|
| 3,270,467 | 9/1966 | Block et al. | 51/358 |
| 4,245,438 | 1/1981 | van Buren, Jr. | 51/377 |

*Primary Examiner*—Frederick R. Schmidt
*Assistant Examiner*—Maurina Rachuba
*Attorney, Agent, or Firm*—Ellsworth R. Roston; Charles H. Schwartz

[57] ABSTRACT

An abrasive disc includes a sheet having abrasive particles on one surface of the sheet. A fastener has a flat flange portion which is adhered to the sheet. Coupling portions on the fastener extend in a transverse direction from the flange portion and legs extends from the free ends of the coupling portion at an angle to the coupling portions. This angle may be between 20° and 75°. The fastener is formed from a sheet of metal which includes the flange portion, the coupling portions and the legs being formed from the portion of the sheet interior to the flange portion. The fastener is constructed to be coupled to a drive member. The drive member includes a housing having a socket. Detent portions are raised in the socket and are provided with detent surfaces. A shaft extends through the center of the socket and has a recess. In the coupled relationship of the disc and the drive member, the coupling portions on the fastener abut the detent surfaces so that the detent surfaces stop the coupling portions from rotating relative to the drive member. In one embodiment, this stopping action is substantially radial and, in another embodiment, this force is substantially tangential. The legs are disposed in the recess in the shaft so that the legs exerts an axial force on the shaft and thus prevent axial displacement of the disc relative to the drive member.

22 Claims, 3 Drawing Sheets

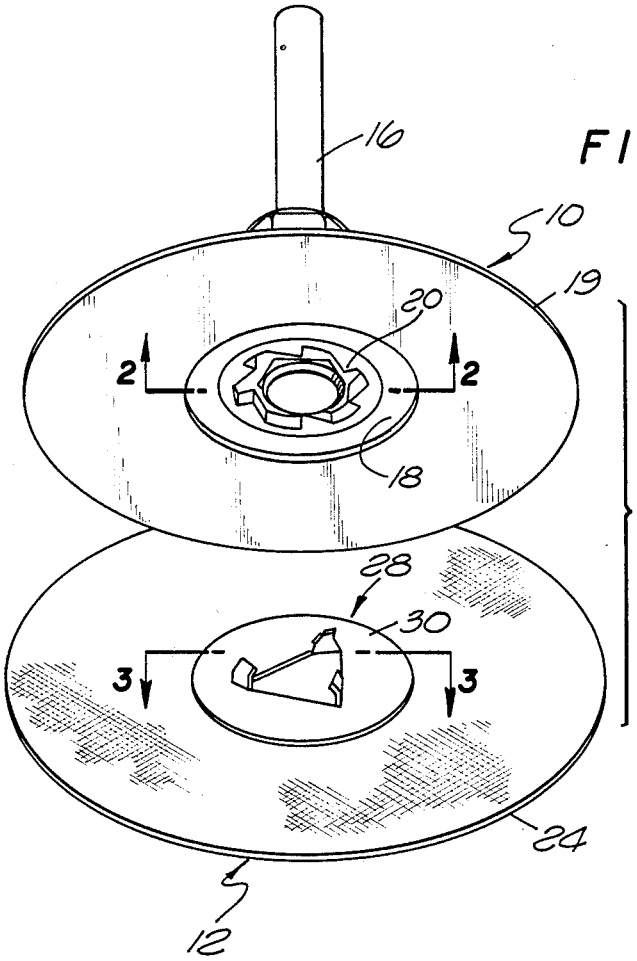
FIG. 1
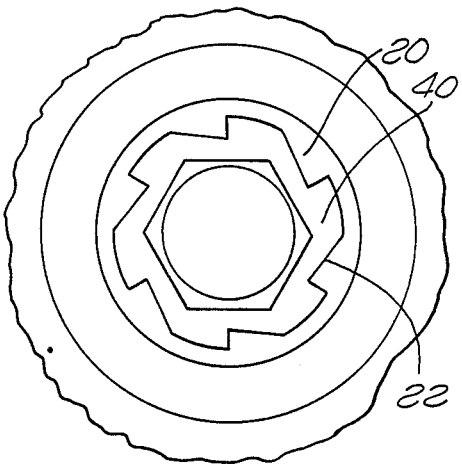
FIG. 2
FIG. 3
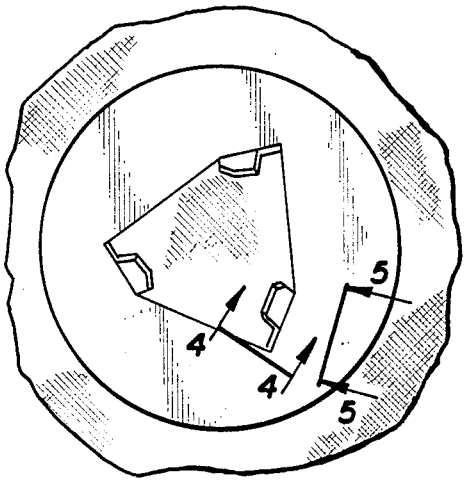
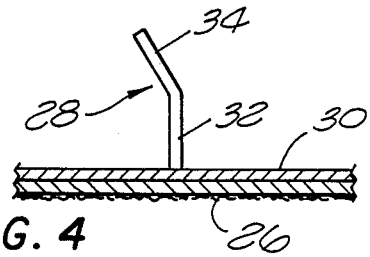
FIG. 4
FIG. 5
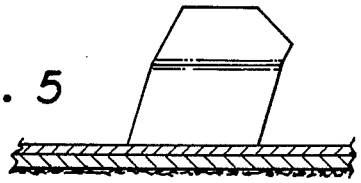

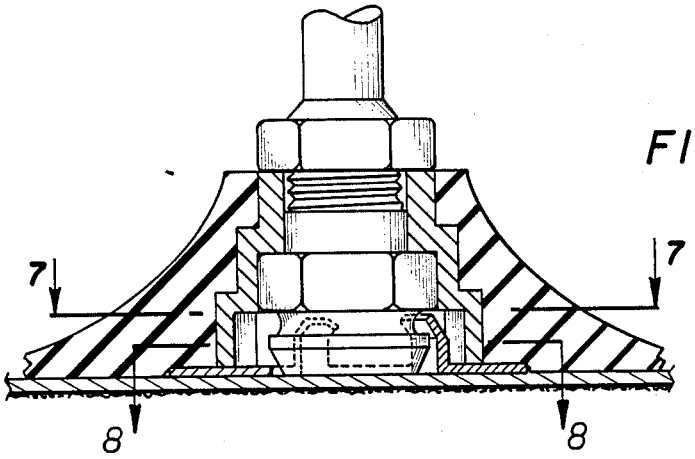
FIG. 6
FIG. 7
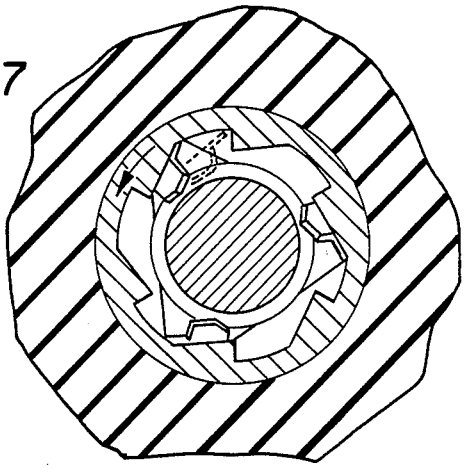
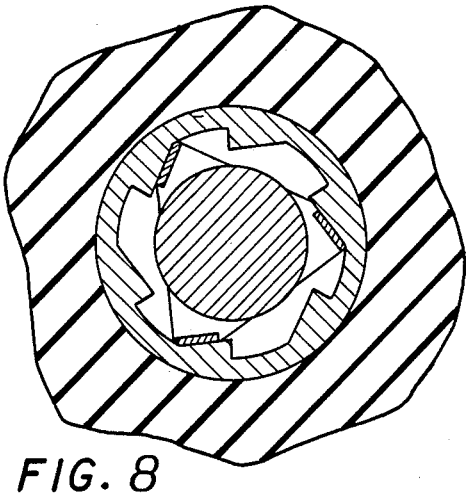
FIG. 8
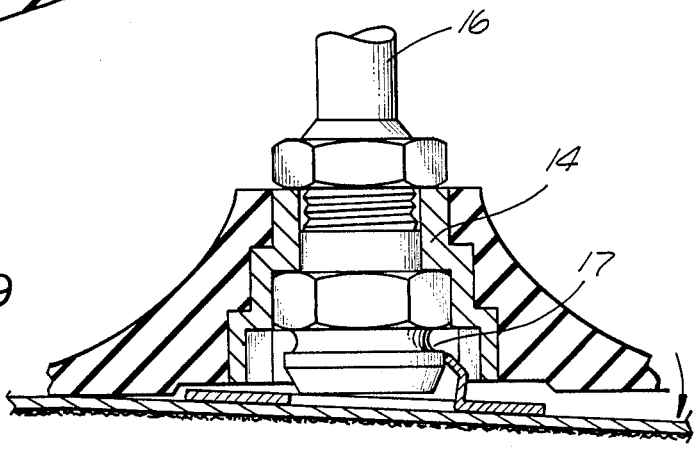
FIG. 9

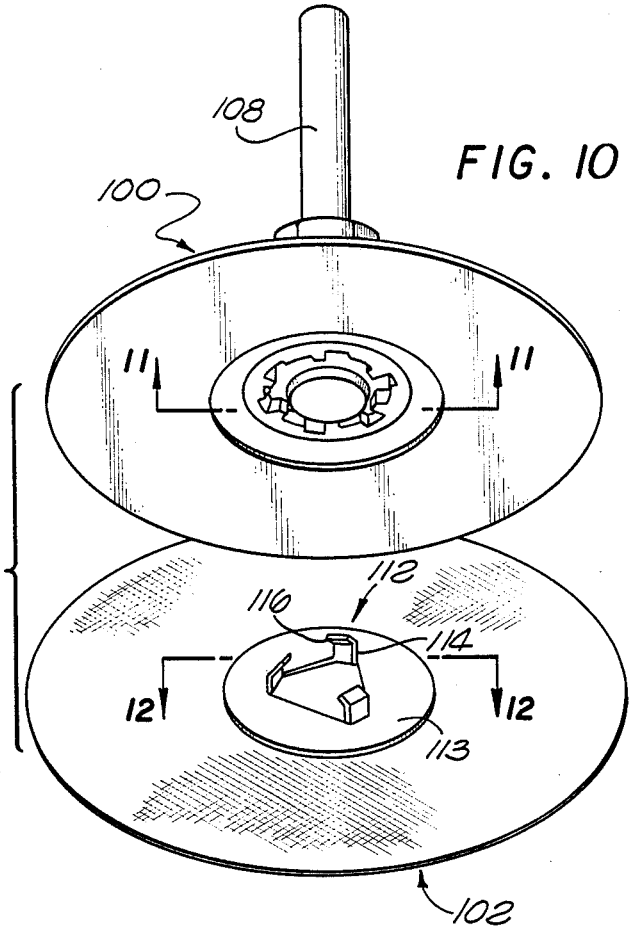
FIG. 10
FIG. 12
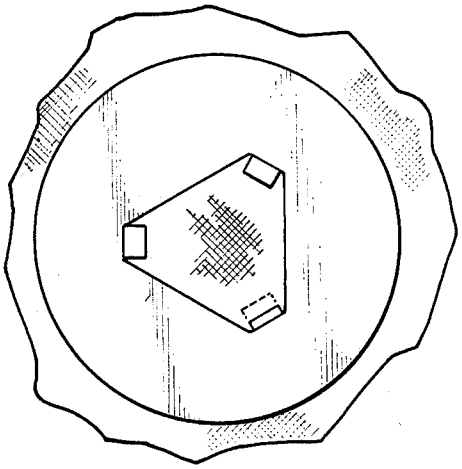
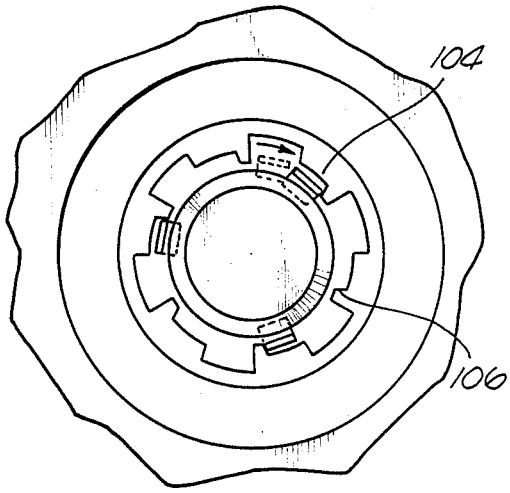
FIG. 11
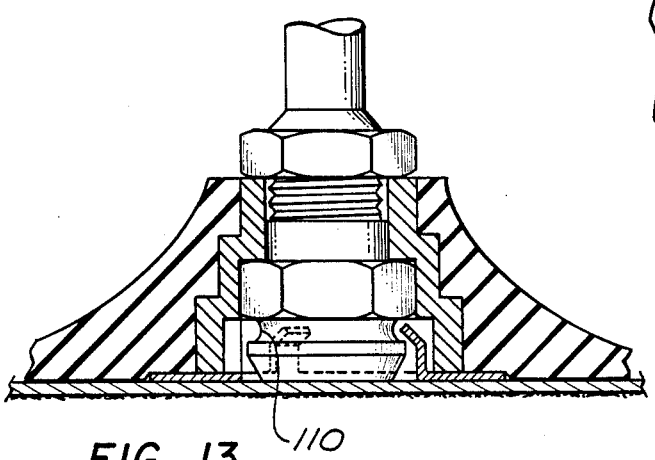
FIG. 13
FIG. 14
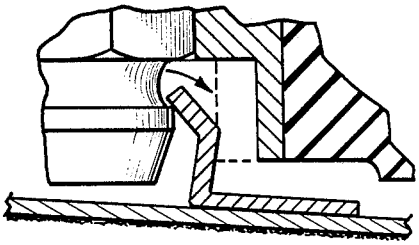

ABRASIVE APPARATUS

This is a continuation of application Ser. No. 819,546 filed Jan. 16, 1986, now abandoned.

This invention relates to an abrasive article and more particularly to an abrasive article which employs a rotary abrasive disc to abrade or polish a workpiece. The invention particularly relates to an abrasive disc which is firmly coupled to a rotary drive member to abrade or polish the workpiece but which is easily decoupled from the drive member after it has been used.

Abrasive articles have been in existence for a considerable number of years to engage a workpiece for polishing the workpiece. One type of abrasive article includes a rotary drive member or holder which has a peripherally disposed housing portion defining a socket or cavity. Detent portions are disposed in the socket in raised relationship to the socket and are sloped. The drive member also has a threaded shank extending axially through the center of the socket. A recessed portion is provided in the shaft at a position corresponding to the detent portions in the socket.

The type of abrasive article discussed in the previous paragraph includes an abrasive disc which includes a fastener made from a plastic material. The fastener has detent portions coupled to the detent portions in the socket of the drive member so as to be driven by the drive member when the drive member is rotated. When the drive member is rotated, the detent portions on the disc, being wedge-shaped in cross-section, become compressed into the recess in the shaft by the sloping detent portions on the drive member. This causes the disc to be driven by the drive member and simultaneously prevented from axial displacement from the drive member. As a result, a backing sheet coupled to the fastener and having abrasive particles on one surface abrades or polishes a workpiece when it engages the workpiece.

The type of abrasive article discussed in the previous paragraphs is disclosed in U.S. Pat. No. Re. 26,552 reissued to Aleck Block and Joseph W. Purcell, Jr. on Mar. 25, 1969, for an "Abrasive Device" and assigned of record to Merit Products, Inc. This type of abrasive article has been effective in a wide variety of applications. However, it has had difficulties in providing an effective coupling between the drive member and the disc under certain circumstances, particularly when the disc has been applied with low torque against the workpiece. This has resulted from the fact that the detent portions on the disc have been insufficiently compressed into the recess on the shaft by the detent portions on the drive member to provide a positive engagement between the drive member and the disc. Another problem has resulted occasionally with the abrasive article of the prior art because the disc has not been able to be decoupled from the drive member after the disc has been applied against a workpiece. This has particularly occurred when the disc has been applied with a great force and torque against the workpiece, thus generating temperatures sufficiently high to distort the coupling member.

The present invention provides an abrasive article which overcomes the above disadvantages. The abrasive article includes a rotary drive member and a disc which is positively coupled to the drive member regardless of the force with which the disc is applied against a workpiece. The abrasive article of this invention is also advantageous because the disc can be easily decoupled from the drive member after the disc has been applied against the workpiece. This decoupling can be easily provided even when the disc has been applied with a great force against the workpiece.

In one embodiment of the invention as disclosed and claimed in this application, an abrasive disc includes a sheet having abrasive particles on one surface of the sheet. A fastener has a flat flange portion which is adhered to the abrasive sheet. Coupling portions on the fastener extend in a transverse direction from the flange portion and legs extend from the free ends of the coupling portion at an angle to the coupling portions. This angle may be between 20° and 75°. The fastener is formed from sheet metal which includes the flange portion, the coupling portions and the legs being formed from the portion of the sheet interior to the flange portion. The fastener is constructed to be coupled to a drive member.

The drive member includes a housing having a socket. Detent portions are raised in the socket and are provided with detent surfaces. A shaft extends through the center of the socket.and has a recess. In the coupled relationship of the disc and the drive member, the coupling portions on the fastener abut the detent surfaces so that the detent surfaces stop the coupling portions from rotating relative to the drive member. In one embodiment, the detents stop the coupling portions by a square abutment of the two parts, and in another embodiment, this stopping action is substantially tangential. The legs are disposed in the recess in the shaft so that the legs exert an axial force on the shaft and thus prevent axial displacement of the disc relative to the drive member.

In the drawings:

FIG. 1 is an exploded perspective view of a drive member and an abrasive disc constituting one embodiment of the invention;

FIG. 2 is a fragmentary sectional view of the drive member shown in FIG. 1 and is taken substantially on the line 2—2 of FIG. 1;

FIG. 3 is a fragmentary sectional view of the disc shown in FIG. 1 and is taken substantially on the line 3—3 of FIG. 1;

FIG. 4 is another fragmentary sectional view of the disc and is taken substantially on the line 4—4 of FIG. 3;

FIG. 5 is a further fragmentary sectional view of the disc and is taken substantially on the line 5—5 of FIG. 3;

FIG. 6 is an elevational view, in section, of the drive member and the disc in an assembled relationship;

FIG. 7 is a fragmentary sectional view of the drive member and the disc and is taken substantially on the line 7—7 of FIG. 6;

FIG. 8 is also a fragmentary sectional view of the drive member and the disc and is taken substantially on the line 8—8 of FIG. 6;

FIG. 9 is an elevational view of the drive member and the disc with the drive member and the disc in a partially detached relationship;

FIG. 10 is an exploded perspective view similar to that shown in FIG. 1 and illustrates another embodiment of a drive member and another embodiment of a disc;

FIG. 11 is a fragmentary sectional view of the embodiment of the drive member shown in FIG. 10 and is taken substantially on the line 11—11 of FIG. 10;

FIG. 12 is a fragmentary sectional view of the disc shown in FIG. 10 and is taken substantially on the line 12—12 of FIG. 10;

FIG. 13 is an elevational view, in section, of the drive member and the disc of FIGS. 10–12 in an assembled relationship; and FIG. 14 is an enlarged fragmentary elevational view, partially in section, of the drive member and the disc of FIGS. 10–13 with the drive member and the disc in a partially detached relationship.

In the embodiment of the invention shown in FIGS. 1 through 9, a drive member generally indicated at 10 and a disc generally indicated at 12 are provided. The drive menber 10 is known in the art. For example, a suitable drive member is shown in FIGS. 6 and 7 of U.S. Pat. No. Re. 26,552 issued on Mar. 25, 1969, to Aleck Block and Joseph W. Purcell, Jr., for an "Abrasive Device" and assigned of record to Merit Products, Inc., of Los Angeles, Calif.

The drive member 10 includes a housing 14 and a drive shaft 16 extending through the housing in axial relationship with the housing and having an annular recess 17 (FIG. 9). The housing 14 is shaped to define a socket 18. The housing 14 may be die cast from a suitable material such as zinc. A pad 19 made from a suitable material such as rubber surrounds the housing 14 to provide a support for the disc 10.

Detent portions 20 are raised from the socket 18 at spaced positions around the periphery of the socket. The detent portions 20 are disposed at equally spaced annular portions around the periphery of the socket 18. Six (6) detent portions 20 are shown in the drawings. However, it will be appreciated that any convenient number of detent portions may be provided. Each of the detent portions 20 progresses radially inwardly toward the center of the drive member 10 with progressive annular positions on the drive member so as to define detent surfaces 22. The detent surfaces extend in a linear direction having radial and tangential components.

The disc 12 includes a sheet 24 having strong properties so that it is capable of bending but not easily. Abrasive particles 26 are adhered to one surface of the sheet A reinforcing sheet of similar flexibility may be laminated to the sheet (24) and thus interposed between the fastener and the abrasive-coated sheet (24). Polyvinyl chloride glue may be used to secure this lamination. A fastener generally indicated at 28 may be adhered to the opposite surface of the sheet 24 or to the exposed surface of the reinforcing sheet. The fastener 28 may be made from a suitable metal such as beryllium copper or steel. The fastener 28 includes a flat flange portion 30 which is adhered to the second surface of the sheet 24 by a catalyzed epoxy and cured at a temperature of 250° F. for a period of two hours.

A plurality of coupling portions 32 extend integrally from the flange portion 30 in a transverse, preferably a substantially perpendicular, relationship to the flange portion. Each of the coupling portions 32 is disposed at an angle to abut an associated one of the detent surfaces 22 in a flush relationship with the detent surface when the disc has been coupled to the drive member and has been applied against a workpiece. Three (3) coupling portions 32 are shown in the drawings for engagement with the detent portions 20. This facilitates the ease of coupling the disc 10 to the drive member 12. Only three (3) coupling portions 22 are required because the coupling portions are quite strong. However, when six (6) detent portions 20 are provided, as many as six (6) coupling portions may also be provided.

The coupling portions 32 extend in a linear direction having radial and tangential components. Projected extensions of the coupling portions 32 define a polygon, preferably with sides of substantially equal length. The linear direction of the coupling portions 32 preferably having a greater tangential component than a radial component.

A leg 34 extends from the outer end of each of the coupling portions 32 at an angle to the associated coupling portion. This angle may be between 20° and 75°. The characteristics of each of the legs 34 cause the leg to extend into the annular recess 17 in the shaft 16 and to engage the shaft 16 at the lower end of the recess as indicated at 36 in FIG. 6. As a result, the force exerted by the shaft 16 on the recess 17 is in an axial direction in FIG. 6.

The legs 34 extend in a linear direction having radial and tangential components. Extended projections of the legs 34 define a polygon, preferably with sides of substantially equal lengths. The linear direction of the legs 32 preferably has a greater tangential component from a radial component.

The disc 12 may be coupled to the drive member 10 by snapping the legs 34 of the fastener 28 into the recess 17 in the shaft 16. The disc 12 may then be rotated manually until the coupling portions 32 abut the detent surfaces 22. The drive member 10 and the disc 12 are then rotated as by a motor (not shown) and the disc 12 is applied against a workpiece (not shown). The abrasive particles 26 on the surface of the sheet 24 cause the workpiece to become abraded or polished.

The disc 12 is retained firmly on the drive member 10 and is prevented from rotation relative to the drive member as the disc is applied against the workpiece. This is true regardless of the magnitude of the force exerted by the disc 12 against the workpiece. The stoppage of relative rotation results from the working torque on the disc driving the coupling portions 32 to a stop upon their abutment against the detent portions 20. Axial separation of the disc from the drive member is prevented in part by the radial confinement of the coupling portions 32 by the detent portions 20, thus holding the legs 34 in position in the shaft recess 17. This prevents axial displacement of the disc by the interference contact of the axial side of the recess 17 with the tips of the legs 34. These forces retain the disc 12 on the drive member 10 without any compression or displacement of the coupling portions 32 or the legs 34.

The disc 12 can be easily removed from the drive member 10 when it has become worn after being applied to a workpiece. This results from the fact that the coupling portions 32 and the legs 34 are not displaced or resiliently sprung in any way regardless of the force applied by the workpiece against the disc 12. This is important because each disc 12 has a relatively short life when it is applied to the workpiece.

To remove the disc 12 from the drive member 10, the disc is first rotated manually in a counterclockwise direction in the drawings. This causes a considerable spacing to be produced between the coupling portions 32 and the wall defining the socket 18 in the drive member 10, as may be seen at 40 in FIG. 2. The disc 12 is then lifted away from the drive member 10. The partial detachment of the disc 12 from the drive member 10 is schematically shown in FIG. 9. The detachment of the disc 12 from the drive member 10 may be facilitated by the force exerted by the shaft 16 on the legs 34 as the disc is removed from the drive member. This force is in a direction to permit arching the coupling portions 32 as the legs 34 cam radially outwardly over the edge of the groove 17. This arching facilitates the decoupling of the disc 12 from the drive member 10.

The fastener 28 can be formed from a sheet of material as by stamping. The coupling portions 32 and the legs 34 can be formed from the portion of the sheet interior to the flange portion 30. In this way, the amount of metal required to form each fasterner 28 can be minimized.

FIGS. 10 through 14 illustrate a second embodiment of the invention. This embodiment includes a drive member generally indicated at 100 and a disc generally indicated at 102. The drive member 100 includes a detent portion 104 with a detent surface 106. The detent portion 104 has a detent surface 106 which extends in a substantially radial direction. The drive member 100 also includes a shaft 108 with a recess 110.

The disc 102 includes a fastener generally indicated at 112. The fastener 112 has a flange portion 113 and coupling portions 114 which extend in a transverse, preferably a substantially perpendicular, direction from the flange portion. Legs 116 extend from the free ends of the coupling portion 114 at an angle to the coupling members. As a result, when the disc 102 is coupled to the drive member 100, the legs 116 engage the recess 110 in the shaft 108 in a manner similar to that discussed above for the embodiment shown in FIGS. 1 through 9. The disc 102 may then be rotated manually in a clockwise direction relative to the drive member 100. This causes the coupling portions 114 to abut the detent surfaces 106 in a substantially perpendicular relationship to the detent surfaces. This force accordingly extends in a direction tangential to the peripheral surface of the shaft 108.

The tangential force discussed in the previous paragraph and the force exerted in the axial direction by the shaft 108 against the legs 116 retain the disc 102 in firmly coupled relationship to the drive member 100 when the disc is applied against the workpiece. The coupling between the disc 102 and the drive member 100 is effective even when the disc is applied with a relatively low torque against a work surface. However, the disc 102 can be easily removed from the drive member 100 even after the disc has been applied against the workpiece with a great force.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for use with a drive member to polish a workpiece where the drive member has a socket, detent portions raised integrally from the socket in fixed relathionship to the socket at spaced positions around the periphery of the socket and extending in a linear direction having radial and tangential components and a centrally disposed shank with a recessed portion on the periphery of the shank, a disc including:

an abrasive sheet having first and second spaced surfaces and having abrasive particles on one surface of the sheet, and a fastener having a flange attached to the second surface of the sheet and having a plurality of coupling portions the coupling portions being planar and extending transversely from the flange in a linear direction having tangential and radial components for engaging the detent portions on the drive member to limit the rotary movement of the fastener when the disc engages the workpiece, the fastener having legs disposed on the coupling portions in the linear direction at an angle radially inwardly from the coupling portion the angle being greater than 90° and less than 180° relative to the associated coupling portion to extend into the recess in the shank and engage the shank at the recess in the shank, the legs being positioned relative to one another to define, with extended projections of such legs, portions of a polygon and the couplng portions being disposed relative to one another to define, within extended projections of such legs, portions of a polygon, the coupling portions and the legs being constructed to be retained by the drive member without any resilient springing of the coupling portions or the legs.

2. A combination as set forth in claim 1 wherein the coupling portions and the legs provide the detent relationships with the drive member without any deformation of the coupling portions and the legs, and without any resilient springing of the coupling portions and the legs, regardless of the force applied by the workpiece against the disc.

3. A combination as set forth in claim 2 wherein each of the coupling portions is substantially perpendicular to the flange and the sides of the polygon defined by the legs, with the extended projections of such legs, have substantially equal lengths and the sides of the polygon defined by the coupling portions, with the extended projections of such coupling portions, have substantially equal lengths.

4. A combination as set forth in claim 1 wherein each of the detent portions on the drive member has a limiting surface which extends radially outwardly in the socket with progressive annular positions and wherein each coupling portion is turned radially inwardly to conform in direction to the limiting surface on the associated detent portion of the drive member at positions radially outward from the radially inner end of the detent portion.

5. A combination as set forth in claim 1 wherein each of the detent portions has a substantially radially disposed shoulder and the coupling portions engage the substantially radially disposed shoulders of the detent portions when the disc engages the workpiece.

6. In combination for use with a drive member to engage a workpiece where the drive member has a socket, detent portions raised integrally from the socket in fixed relationship to the socket at spaced positions around the periphery of the socket and extending in a linear direction having radial and tangential components and a centrally disposed shank with a recessed portion on the periphery of the shank, a disc including:

a sheet having first and second opposite surfaces and having abrasive particles on the first surface, and a fastener attached to the disc and extending from the disc, the fastener having a flange disposed against the sheet for supporting the sheet, the fastener having at least a pair of coupling portions the coupling portions being planar and extending from the flange in a linear direction having tangential and radial components and further having at least a pair of legs each extending from an associated one of the coupling portions and disposed in the linear direction at a position radially inwardly from the associated coupling portion, each of the coupling portions being constructed to engage the detent portions of the drive member with a force having a radial component when the disc is being applied against the workpiece, each of the legs being constructed to be disposed in the recessed portion of the shank and to engage the shank at the recessed portion in the shank in an axial direction when the fastener has been attached to the drive member, each of the coupling portions and the legs being constructed to engage the detent portions and the shank without any resilient springing of the coupling portions and the legs wherein the radially inward position of the legs relative to an associated coupling portion is an angle greater than 90° and less than 180°.

7. A combination as set forth in claim 6 wherein the leg is bent in a direction having a component extending radially inwardly relative to the coupling portion to extend into the recess in the shank and engage the shank in the axial direction at the recessed portion in the shank.

8. A combination as set forth in claim 7 wherein the fastener is made from a material selected from the group consisting of steel and beryllium copper.

9. A combination as set forth in claim 7 wherein extensions of the coupling portions define a first polygon and extensions of the legs define a second polygon radially inwardly of the first polygon.

10. A combination as set forth in claim 8 wherein each coupling portion is substantially perpendicular to the flange.

11. In combination for use with a drive member to engage a workpiece where the member has a socket, detent portions raised integrally from the socket in fixed relationship to the socket at spaced positions around the periphery of the socket and extending in a linear direction having radial and tangential component and a centrally disposed shank with reoessed portion at the periphery of the shank, a disc including:

a sheet having first and second opposite surfaces and having abrasive particles on the first surface, and a fastener including a flat flange adhered to the sheet and having at least a pair of coupling portions, the coupling portions being planar and extending from the sheet and constructed to extend in a linear direction having components of force in a radial direction and tangential direction and to define a detent relationship with the detent portions, the fastener also including a pair of leg portions each disposed on the outer end of an associated one of the coupling portions and extending in the linear direction at an angle relative to the coupling portions which is greater than 90° and less than 180°, the leg portions being constructed to be retained, without any springing of the coupling portions on the legs, in the recess in the shank by a force produced between the shank and the legs and having an axial components and a force produced between the detent portions and the coupling portions.

12. In a combination as set forth in claim 11, the coupling portions and the legs being constructed with the legs disposed radially inwardly of the coupling portions.

13. In a combination as set forth in claim 11, the coupling portions and the legs being constructed to provide for an uncoupling of the disc from the drive member without any distortion of the fastener or the sheet member.

14. In a combination as set forth in claim 12, the coupling portions and the legs being disposed to extend in a direction in which the tangential component is greater than the radial component.

15. In a combination as set forth in claim 11, the coupling portions and the legs and the flange being formed from a flat sheet of metal and the coupling portions and the legs extending from the flange at an intermediate position along the radial length of the flange and being formed from portions of the sheet radially interior to the position at which the coupling portions and the legs extend from the portion of the sheet defining the flange.

16. In combination for use in abrading or polishing workpiece, a drive member having a housing defining a socket, a detent portion raised integrally from the socket in fixed relationship to the socket at spaced positions around the periphery of the socket and a shank extending into the socket and having a recessed portion at the periphery of the shank at a position within the socket, the recessed portion being defined by a plurality of detent surfaces each extending in a substantially linear direction having radial and tangential components, a sheet member having first and second opposite surfaces and having abrasive particles on the first surface, and a fastener having a flange adhered to the sheet member in flattened relationship with the sheet member and having coupling portions, the coupling portions being planar and extending transversely from the second surface of the sheet member, the coupling portions being constructed to define with the detent surfaces of the drive member a detent relationship providing a force against the fastener in the socket to facilitate the retention of the fastener on the drive member, the fastener also having a plurality of legs each disposed at the outer end of associated one of the coupling members in a direction having a component extending radially inwardly to the recessed portion in the shank of the drive member and retained in the recessed portion in the shank of the drive member the radially inward position of the legs being at an angle relative to an associated coupling portion of greater than 90° and less than 180° and providing, against the recessed portion of the shank, a force in an axial direction to retain the fastener on the drive member during the application of the sheet member against the workpiece, each of the coupling portions and the associated one of the legs extending in a substantially linear direction corresponding substantially to the substantially linear direction of an associated one of the detent surfaces, the coupling portions and the legs being constructed to provide for a retention of the legs by the shank and a retention of the coupling portions by the detent portions without any springing of the coupling portions or the legs.

17. In a combination as recited in claim 16, the force exerted by the drive member against the fastener in the socket having a radial component and a tangential component, the tangential component of each of the coupling portions and the associated one of the legs in the linear diroction being greater than the radial component.

18. In a combination as recited in claim 16, the fastener being made from a suitable metal such as a metal selected from the group consisting of beryllium, copper and steel.

19. In a combination as recited in claim 16, the fastener being constructed and disposed relative to the drive member to be retained by the drive member regardless of the force applied by the workpiece against the disc and without any distortions of the flange, the coupling portion and the leg on the fastener.

20. In a combination as recited in claim 19, the coupling portions being disposed relative to one another to define a first polygon with extended projections of the coupling portions and the legs being disposed relative to one another to define a second polygon with extended projections of the legs.

21. In a combination as recited in claim 16, the coupling portions extending from the flange substantially perpendicularly relative to the flange and the first polygon defined by the extended projections of the coupling portions having substantially equal sides and the second polygon defined by the extended projections of the legs having substantially equal sides.

22. In a combination as set forth in claim 1, the fastener being made from a suitable metal such as a metal selected from the group consisting of beryllium, copper and steel.

* * * * *